US006598772B1

(12) United States Patent
Wilfer

(10) Patent No.: US 6,598,772 B1
(45) Date of Patent: Jul. 29, 2003

(54) CASE FOR MUSICAL INSTRUMENTS

(76) Inventor: Hans-Peter Wilfer, Am Hackerhof 5, D-08258 Markneukirchen (DE)

( * ) Notice: Subject to any disclaimer, the term of this patent is extended or adjusted under 35 U.S.C. 154(b) by 0 days.

(21) Appl. No.: 09/690,221

(22) Filed: Oct. 17, 2000

(30) Foreign Application Priority Data

Dec. 23, 1999 (EP) ..... 99125742

(51) Int. Cl.[7] ..... A45F 3/04

(52) U.S. Cl. ..... 224/629; 224/643; 224/644; 224/910; 206/314

(58) Field of Search ..... 224/628, 629, 224/630, 642, 643, 644, 910, 627, 631; 206/314

(56) References Cited

U.S. PATENT DOCUMENTS 1,334,582 A * 3/1920 Archibald ..... 224/628 X
2,350,184 A * 5/1944 Oys ..... 220/318
2,611,519 A 9/1952 Utterström
3,254,816 A * 6/1966 Gray ..... 224/630
5,366,126 A * 11/1994 Dausien ..... 224/630
5,918,785 A * 7/1999 Irose ..... 224/250
6,092,702 A * 7/2000 Cassidy, IV ..... 224/153
6,164,505 A * 12/2000 Holter et al. ..... 224/259

FOREIGN PATENT DOCUMENTS

EP 0756266 1/1997
FR 2325334 4/1977

* cited by examiner

*Primary Examiner*—Stephen K. Cronin

(57) ABSTRACT

A case for musical instruments and including a shell for receiving a musical instrument and having at least one shoulder strap attachable from outside to the shell at upper and lower attachment points provided of the shell, a connection element provided at an end of the shoulder strap adjacent to the upper attachment point for releasably securing the shoulder strap to the shell, and an upholstery cover provided on the shell or the shoulder strap for covering at least a portion of the connection elements.

8 Claims, 2 Drawing Sheets

CASE FOR MUSICAL INSTRUMENTS

BACKGROUND OF THE INVENTION

1. Field of the Invention

The present invention relates to a case for musical instruments and including a shell for receiving a musical instrument and having at least one shoulder strap attachable from outside to the shell at upper and lower attachment points provided on the shell and a connection element provided at an end of the shoulder strap adjacent to the upper attachment point for releasably securing the shoulder strap to the shell.

2. Description of the Prior Art

For transporting musical instruments, in particular, guitars and bass-guitars, cases, which can be relatively easy carried on the shoulders, are used. The shoulder straps, for different reasons, are primarily releasably connected with the case and, if necessary, can be removed. For connecting the shoulder strap with the shell, a connection element is used which, e.g., can be formed of an eyelet and a karabiner. However, the parts of the connection elements, in particular, karabiners, buckles, hooks and the like can be damaged, and with an instrument being carried on the shoulders, they can leave pressure marks in the shoulder region which are troublesome to the user.

Accordingly, an object of the present invention is to provide a case for musical instruments which, despite the removable shoulder strap, can be comfortably carried on the shoulder.

SUMMARY OF THE INVENTION

This and other objects of the present invention, which will become apparent hereinafter, are achieved by providing an upholstery cover on the shell or the shoulder strap for covering at least a portion of the connection element. According to the invention, the upholstery cover is so arranged on the shell or the shoulder strap that it covers the irksome parts. The upholstery cover absorbs the pressure applied by the parts of the connection element and distribute it over a larger surface. The upholstery cover provides for substantially uniform load distribution in the shoulder region of the user.

The present invention is not limited to cases for guitars or case-guitars but rather can be used in any cases for carrying musical instruments on the shoulder such as, e.g., keyboards, pianos, drums, brass instruments, accordions, mixing console, and the like.

In accordance with a preferred embodiment of the present invention, the upholstery cover has one of its ends permanently secured to the case shell in the region of the upper attachment point. Its free, opposite end, with the released shoulder strap, can extend parallel to the shell so that the shell-side portion of the connection element, e.g., the metallic eyelet, is covered by the upholstery cover. In this embodiment, the upholstery cover has a double function. On one hand, the cover is arranged between the shoulder of the user and the connection element, protecting the shoulder region of the user. On the other hand, in its pivotal by 180° position, the cover covers the shell-side portion of the connection element, so that this portion of the connection element does not have any exposed points susceptible to being damaged. According to a further preferred embodiment of the present invention, a two-element hook-and-loop connection, generaly known as a VELCRO® connection, is used for attaching the free end of the upholstery cover to the shell. To this end, the upholstery cover is provided with one of the VELCRO®-type elements which engages an another corresponding VELCRO®-type element provided on the shell. The VELCRO®-type element, which is provided at the free end of the upholstery cover, permits to secure it in a desired position. It is to be noted that the VELCRO®-type elements are soft and light.

In order to prevent slippage between the upholstery cover and the shoulder strap during transportation of the case with the musical instrument or without, a VELCRO®-type element is also provided on the shoulder strap which the VELCRO®-type element provided at the free end of the upholstery cover engages. This prevents displacement of the upholstery cover from its protecting position beneath the shoulder strap.

The novel features of the present invention, which are considered as characteristic for the invention, are set forth in the appended claims. The invention itself, however, both as to the construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
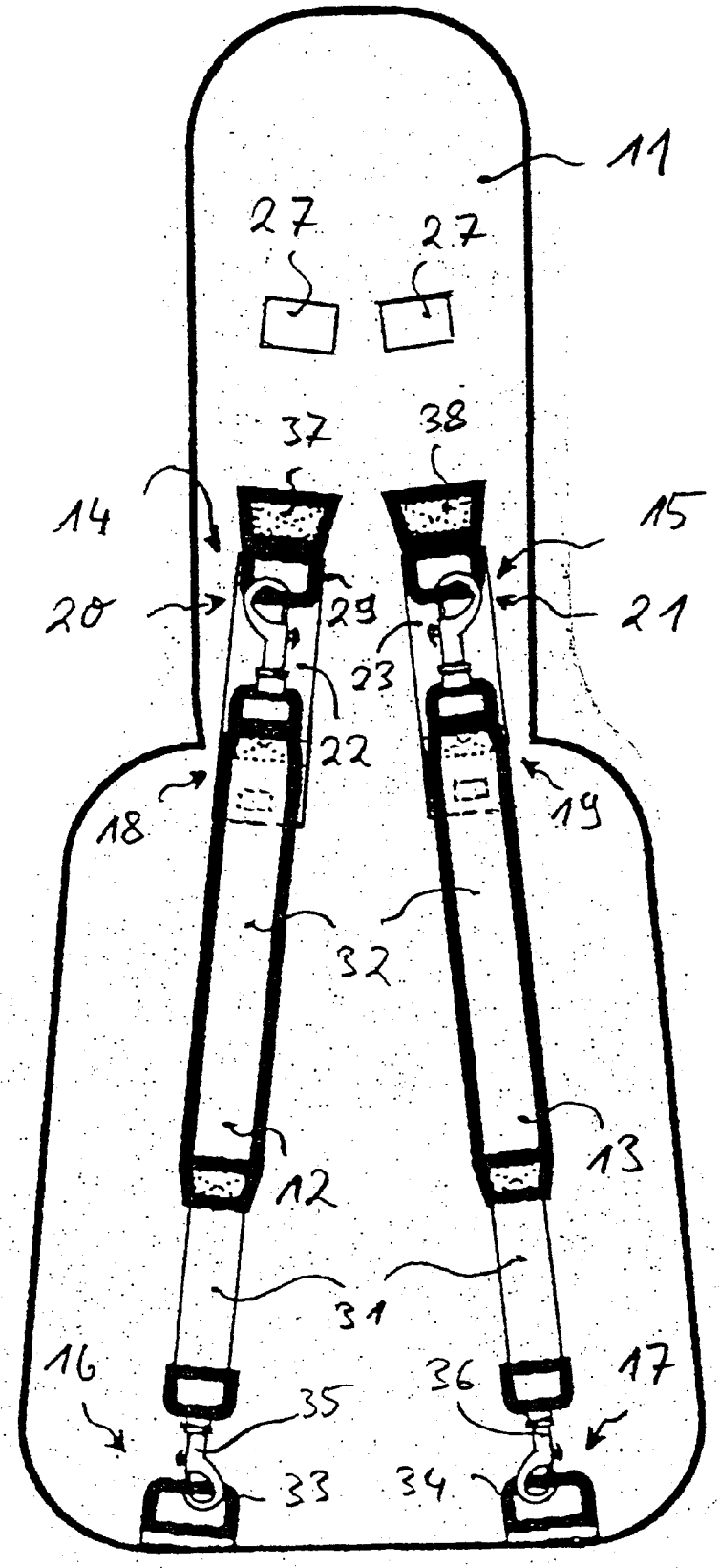
FIG. 1 a schematic view of a case for musical instruments according to the present invention.

A case for musical instruments, such as guitare or bass-guitare, according to the present invention which is shown in FIG. 1, includes a lockable shell 11, in which a guitare or a bass-guitare is received, and two shoulder straps 12, 13. The shoulder straps 12, 13 permit to carry the case on one's shoulders as a rucksack which noticeably facilitates the transportation of heavy musical instruments. The shoulder straps 12 and 13 are releasable secured at two upper attachment points 14, 15 and two lower attachment points 16, 17 which are provided on the shell 11. As it is conventional in rucksacks, in the embodiment shown in the drawings, the upper attachment points 14, 15 are located closer to each other than the lower attachment points 16, 17. The shoulder straps 12, 13 each have a thin section 31 and a thick upholstered section 32. The upholstered sections 32 are provided in the upper portions of the respective shoulder straps 12, 13 adjacent to respective upper attachment points 14, 15. The thin sections 31 extend between the upholstered sections 32 and respective lower attachment points 16, 17.

Advantageously, the length of the shoulder straps 12, 13 can be adjusted so that it can be optimally adapted to the anatomy of a case user. The length adjusting element (not shown) can be preferably provided in the region of the thin section 31 of the respective shoulder strap 12, 13.

According to an envisaged arrangement of the length adjusting element, the thin section 31 can be formed of two parts, with the length adjusting element being formed as a buckle provided between the two parts, with the buckle being adjusted in a manner conventional for belt buckles.

At the upper ends 18, 19 of the shoulder straps 12, 13 adjacent to the upper attachment points 14, 15, there are provided connection elements 20, 21 including each a metallic eyelet 29, which is secured to the shell 11, and a karabiner 30 which is attached to an end of a respective upholstered section 32 of the respective strap 12, 13. At attachment points 16 and 17, correspondingly, eyelets 33, 34 and karabiners 35, 36 are provided. The eyelets 29, 33, 34 can be sewn in U-shaped textile trimmings 37, 38 and be secured to the shell 11 by sewing the trimmings 37, 39 to the shell 11.

Figure 2:
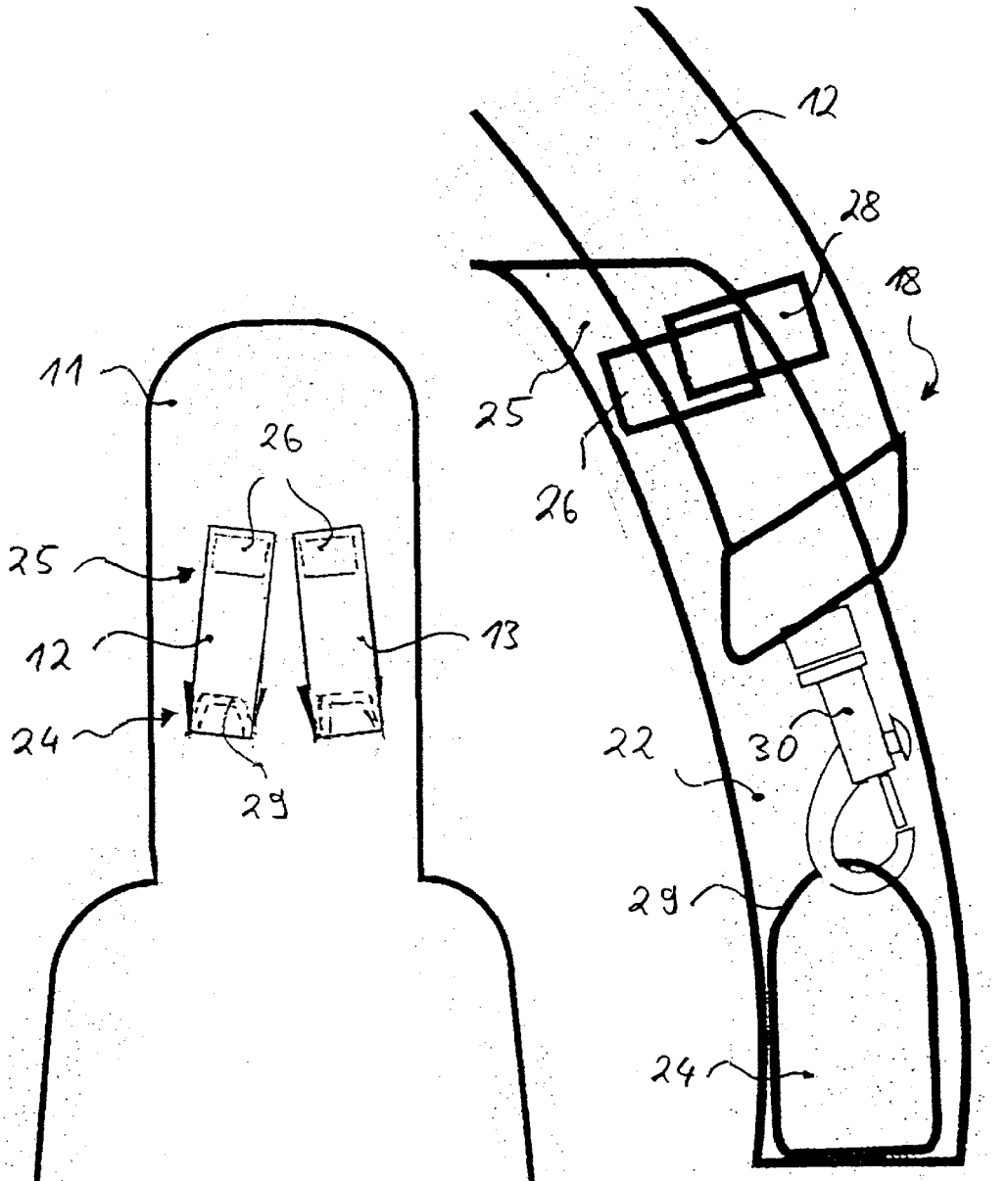
FIG. 2 a partial perspective view showing a detail of the case shown in FIG. 1.

Beneath the textile trimmings 37, 38, in the region of the upper attachment points 14, 15, first ends 24 of respective upholstery covers 22, 23 are secured to the shell 11, preferably, sewed thereto. The opposite, free ends 25 of the upholstery covers 22, 23 can occupy two different positions. In the first position, the free ends 25 of the upholstery covers 22, 23 can be drawn to the lower attachment points 16, 17 of the shell 11, so that each upholstery cover 22, 23 (only one upholstery cover is shown in FIG. 2) covers the connection element 20, 21 with the eyelet 29 and the karabiner 30, with the upholstery cover 22, 23 being located between the connection device 20, 21 and the shell 11. In order to prevent the displacement of the upholstery cover 22, 23 from its covering petition, a VELCRO®-type element 26 is provided at the free end 25 for engaging a corresponding element 28 of the shoulder strap. The attachment of the free end of the upholstery cover 22, 23 to the shoulder strap is shown, as discussed above, in FIG. 2. As shown in FIG. 2, the VELCRO®-type elements are so arranged that the upholstery cover 22, 23 is fixedly attached to the respective shoulder strap 12, 13 when the later is loaded. Thereby, the slippage or displacement of the upholstery cover relative to the shoulder strap is prevented.

Figure 3:
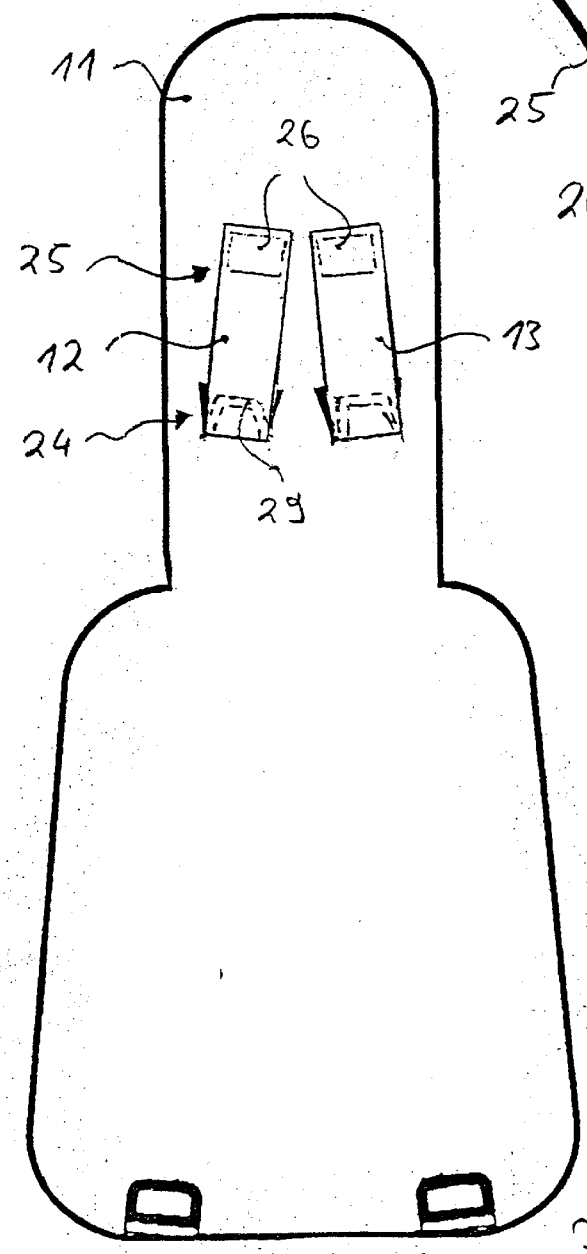
FIG. 3 a schematic view of the case shown in FIG. 1, with the shoulder strap being detached and the upholstery cover being folded down.

FIG. 3 shows additional functions of the upholstery covers 22, 23 which can be displaced, with a pivotal movement, into a second position, in which they are pulled away from the lower attachment points 16, 17.

In this position, the upholstery cover 22, 23 is pivoted by about 180° with respect to the first position shown in FIG. 1, with the VELCRO®-type elements 26 engaging VELCRO®-type element 27 provided on the shell 11, with the upholstery covers 22, 23 occupying their release position. In this position, the upholstery covers 22, 23 cover a portion of the connecting elements 20, 21, namely, the metallic eyelets 29. This prevents the eyelets 29 from any damage or from an undesirable interlock with other parts.

The present invention significantly facilitate carrying of the musical instruments, without any increase in manufacturing costs or in weight of the case.

Through the present invention was shown and described with references to the preferred embodiments, such are merely illustrative of the present invention and are not to be construed as a limitation thereof and various modifications of the present invention will be apparent to those skilled in the art. It is therefor not intended that the present invention be limited to the disclosed embodiments or details thereof, and the present invention includes all variations and/or alternate view embodiments within the spirit and scope of the present invention as defined by the appended claims.

What is claimed is:

1. A case for musical instruments, comprising a shell for receiving a musical instrument and having at least one shoulder strap attachable from outside to the shell at upper and lower attachment points provided of the shell; connection means provided at an end of the shoulder strap adjacent to the upper attachment point for releasably securing the shoulder strap to the shell; and an upholstery cover provided on one of the shell and the shoulder strap for substantially covering the connection means.

2. A case as set forth in claim 1, wherein the connection means comprises an eyelet provided on the shell and karabiner provided on the upper end of the shoulder strap.

3. A case as set forth in claim 1, wherein the case comprises two shoulder straps, two connection means, and two upholstery covers associated with respective connection means.

4. A case as set forth in claim 1, wherein the upholstery cover has a first end thereof, attached to the shell in a region of the upper attachment point thereof, and has a free end which lies, with the shoulder strap being released from the shell, parallel to the shell, covering the shell-side of the connection means between the shell and the upholstery cover.

5. A case as set forth in claim 1, further comprising means for connecting the free end of the upholstery cover with the shell so that the upholstery cover extends parallel to the shell and covers the upper attachment point.

6. A case as set forth in claim 5, wherein the connecting is formed as a two-element hook-and-loop connection means having a first element thereof secured to the free end of the upholstery cover, and a second element thereof secured to the shell.

7. A case as set forth in claim 1, further comprising means for securing the free end of the upholstery cover to the shell without a possibility of slippage.

8. A case as set forth in claim 1, wherein the securing means one element thereof is formed as a two-element hook-and-loop connection means having one element thereof secured to the shell and another element thereof secured to the free end of the upholstery cover.

* * * * *